US008698383B2

(12) United States Patent
Wang et al.

(10) Patent No.: US 8,698,383 B2
(45) Date of Patent: Apr. 15, 2014

(54) ANODE OF AN ARC PLASMA GENERATOR AND THE ARC PLASMA GENERATOR

(75) Inventors: Yupeng Wang, Yantai (CN); Yi Li, Yantai (CN); Shuo Yang, Yantai (CN); Jinhua Yang, Yantai (CN)

(73) Assignee: Yantai Longyuan Power Technology, Co., Ltd., Yantai (CN)

( * ) Notice: Subject to any disclaimer, the term of this patent is extended or adjusted under 35 U.S.C. 154(b) by 234 days.

(21) Appl. No.: 13/144,589

(22) PCT Filed: Jan. 19, 2010

(86) PCT No.: PCT/CN2010/070250

§ 371 (c)(1),
(2), (4) Date: Sep. 20, 2011

(87) PCT Pub. No.: WO2010/081436

PCT Pub. Date: Jul. 22, 2010

(65) Prior Publication Data

US 2012/0025693 A1 Feb. 2, 2012

(30) Foreign Application Priority Data

Jan. 19, 2009 (CN) ..... 2009 1 0014106

(51) Int. Cl.
*H01J 17/26* (2012.01)

(52) U.S. Cl.
USPC ..... 313/231.51; 313/326

(58) Field of Classification Search
USPC ..... 313/231.31, 231.41, 231.51, 326
See application file for complete search history.

(56) References Cited

U.S. PATENT DOCUMENTS

| | | | | |
|---|---|---|---|---|
| 4,674,683 | A | 6/1987 | Fabel | |
| 5,374,802 | A * | 12/1994 | Dorfman et al. | 219/121.52 |
| 7,281,478 | B2 | 10/2007 | Wang | |
| 2006/0108332 | A1 | 5/2006 | Belashchenko | |

FOREIGN PATENT DOCUMENTS

| | | | |
|---|---|---|---|
| CN | 87 1 03360 | A | 11/1987 |
| CN | 2521510 | Y | 11/2002 |
| CN | 201352880 | Y | 11/2009 |
| WO | 2007/114556 | A1 | 10/2007 |

OTHER PUBLICATIONS

International Search Report mailed Apr. 22, 2010, in corresponding International Application No. PCT/CN2010/070250, filed Jan. 19, 2010, 2 pages.

* cited by examiner

*Primary Examiner* — Anh T. Mai
*Assistant Examiner* — Andrew Coughlin
(74) *Attorney, Agent, or Firm* — Christensen O'Connor Johnson Kindness PLLC

(57) ABSTRACT

An anode of an arc plasma generator and the arc plasma generator are disclosed. The plasma generator is a multi-stage gas admission type arc plasma generator, and the plasma generator includes a cathode and an anode. The anode comprises at least two portions (201, 203), wherein any two adjacent portions of the anode are connected electrically with one another.

9 Claims, 7 Drawing Sheets

ANODE OF AN ARC PLASMA GENERATOR AND THE ARC PLASMA GENERATOR

The present application is the National Stage application of PCT/CN2010/070250, filed Jan. 19, 2010, which claims the benefit of Chinese application No. 200910014106.6, filed on Jan. 19, 2009. The disclosure of each application is incorporated herein by reference in its entirety.

TECHNICAL FIELD

The present invention generally relates to the technical field of plasma, and more specifically, to an anode of an arc plasma generator and the arc plasma generator.

DESCRIPTION OF RELATED ART

Recently, since arc plasma as a special hot source is applied more and more widely, arc plasma technique is developed rapidly. However, with the demand on temperature of arc plasma jet flow in new application fields becoming higher and higher, conventional arc plasma generator cannot satisfy its demand any more. In order to satisfy the demand, an arc plasma generator with simple structure and higher output power is needed to be developed in urgency. There are mainly two methods to increase the output power of the arc plasma generator: increasing the operating current and improving the discharge voltage. If the method of increasing the current of the arc plasma generator is adopted, the requirement to the electrical device is strict and the cost is increased, and this method will cause more burning damage to electrode, and will shorten the service life of the anode and cathode of the arc plasma generator. Therefore, the method of improving voltage is normally adopted to increase output power of the arc plasma generator.

At present, widely used arc plasma generator is a type of generator with single stage of anode gas admission. If desired to increase the output voltage thereof on this basis, it can be achieved only by improving structure of the anode and lengthening the arc. However, it is difficult to achieve the goal due to the limit of the single stage of anode gas admission structure.

Another kind of conventional method of increasing voltage of an arc plasma generator is to increase the voltage by arc transferring technique to forcibly lengthen the arc. The anodes of such plasma generator are connected in isolation sequentially. When the generator operates, with steps of firstly initiating a cathode and a first anode to generate an arc; and then by a circuit between the cathode and the first anode, at the time of disconnecting the circuit between the cathode and the first anode, closing the circuit between the cathode and a second anode, so that anode arc root is transferred to the second anode from the first anode; with these steps, the anode arc root can be transferred to a third anode, a fourth anode etc. With the method of transferring arc in force, the arc is lengthened, and the voltage of the arc plasma generator is increased, and the power of the arc plasma generator is further improved. However, the operating process is relatively complicated as the plasma generator relates to switching the switches during the operating process. Since the anode insulating connection of the generator is of relatively complicated structure, there are too many fault points, and the operation is complicated. The process of arc transferring is instable, insulating components connected between the anodes are easy to be burned out. And the arc transferring will succeed only after the operation is operated several times, the reliability of the device is affected.

In reference to FIG. 1, showing a structure diagram of the dual-anode plasma generator with insulation between the anodes in the prior art, the plasma generator includes a cathode 101, a first anode 102, an gas insulating ring 103, a water-cooling channel 104 and a second anode 105.

The operation principle of the dual-anode plasma generator in the prior art is: the gas insulating ring 103 insulates the first anode 102 from the second anode 105, the water-cooling channel 104 cools the first anode 102 and the second anode 105; when the dual-anode plasma generator is initiated, the first anode 102 is connected to the positive pole of the electrical source firstly. After arcing at high frequency, an arc is formed between the first anodes near the cathode 101, and high temperature plasma jet passes the second anode 105. Since the high temperature plasma is not recombined completely at the moment of disconnecting the first anode 102 and the electrical source, there exists a conductive path between the second anode 105 and the cathode 101, and the arc is pulled to a farther second anode 105 in force, and the arc transferring is achieved, and a long arc with higher voltage drop is obtained.

Though the dual-anode plasma generator in the prior art can improve the wind field in the generator by two-stage gas admission, lengthen the plasma arc and improve the power of the plasma, the anode insulating connection in the generator renders the structure relatively complicated, too many fault points and complicated operation. When the dual-anode plasma generator is initiated, the first anode is connected to the positive pole of the electrical source. After arcing at high frequency, an arc is formed between the first cathodes near the cathode, and high temperature plasma jet flows through the second anode. Since high temperature plasma is not recombined completely at the moment of disconnecting the first anode and the electrical source, there exists a conductive path between the second anode and the cathode, and the arc is pulled to a farther second anode in force, and the arc transferring is achieved, and a long arc with higher voltage drop is obtained. The process of arc transferring is very instable, insulating components connected between the anodes are easy to be burned out. And the process will succeed only until the operation is operated several times, the reliability of the device is affected. When the generator operates, dual-arc phenomena (that is, there exist plasma arcs between the cathode and each stage of the anode) occurs frequently, the insulating material between the stages of the anodes is burned out, and safety of the device is affected.

SUMMARY OF INVENTION

The present invention has the object to provide an anode of an arc plasma generator and the arc plasma generator with higher output power.

The embodiments of the present invention adopt the following technical solutions:

An anode of an arc plasma generator, the plasma generator is a multi-stage gas admission type arc plasma generator, the plasma generator includes a cathode and an anode, the anode comprises at least two portions, wherein any two adjacent anode portions are connected electrically with one another.

Wherein, the anode portion farthest from the cathode includes any one of the following components: a gradually narrowing-expanding throat component, a gradually narrowing throat component, a component consisted of a gradually narrowing throat and a gradually expanding throat, and a straight section component.

Wherein, the anode portion nearest to the cathode includes a gradually narrowing-expanding throat component.

Wherein, except the anode portion farthest from the cathode, all of the remainder of the anode portions include respectively a gradually narrowing-expanding throat component.

Wherein, there are provided gas guiding holes between any two adjacent anode portions, the gas guiding holes are tangential holes or holes that cause the direction of gas flow speed to possess both tangential and axial vectors simultaneously.

Wherein, the gas guiding holes are distributed over the anode or a gas ring uniformly.

Wherein, end faces of the two adjacent anode portions adjoin and contact one another sufficiently, at the contact position, the diameter of the anode portion farther from the cathode is bigger than that of the other anode portion to form a flow guiding groove at the contact position, introducing the medium gas introduced by the gas guiding holes into the plasma generator in order.

Wherein, the flow guiding groove forms a channel along with an intracavity of the anode, in which the gas flow exported by the gas guiding holes goes forward spirally along the wall of the intracavity of the anode and the arc root is conveyed forward into the anode portion farthest from the cathode.

An arc plasma generator, the plasma generator is a multi-stage gas admission type arc plasma generator, the plasma generator includes a cathode and an anode, the anode comprises at least two portions, wherein any two adjacent anode portions are connected electrically with one another.

Wherein, the anode portion farthest from the cathode includes any one of the following components: a gradually narrowing-expanding throat component, a gradually narrowing throat component, a component consisted of a gradually narrowing throat and a gradually expanding throat, and a straight section component.

Wherein, the anode portion nearest to the cathode portion is a gradually narrowing-expanding throat component.

Wherein, except the anode portion farthest from the cathode, all of the remainder of the anode portions are respectively a gradually narrowing-expanding throat component.

Wherein, there are provided gas guiding holes between any two adjacent anode portions, the gas guiding holes are tangential holes or holes that cause the direction of gas flow speed to possess tangential and axial vectors simultaneously.

Wherein, the gas guiding holes are distributed over the anode or a gas ring uniformly.

Wherein, end faces of the two adjacent anode portions adjoin and contact one another sufficiently, at the contact position, the diameter of the anode portion farthest from the cathode is bigger than that of the other anode portion to form a flow guiding groove, introducing the medium gas introduced by the gas guiding holes into the plasma generator in order.

Wherein, the flow guiding groove forms a channel along with an intracavity of the anode, in which the gas flow exported by the gas guiding holes goes forward spirally along the wall of the intracavity of the anode and the arc root is conveyed forward into the anode portion farthest from the cathode.

Wherein, there is provided a gas insulating ring between the cathode and the anode portion nearest to the cathode.

Wherein, the plasma generator is an arc plasma generator of hot cathode type, there are provided gas guiding holes between the cathode and the anode portion nearest to the cathode, the gas guiding holes are tangential holes or holes that cause the direction of gas flow speed to possess tangential and axial vectors simultaneously.

Wherein, the plasma generator is an arc plasma generator of cold cathode type, there are provided gas guiding holes between the cathode and the anode portion nearest to the cathode, the gas guiding holes are tangential holes.

The technical effects of the above technical solutions are as follows:

After adopting above technical solutions, since the anode portions are connected electrically therebetween, the problem that the insulating connection between the anode portions causes too many fault points and affects arc stability is avoided. When the multi-stage gas admission type plasma generator of the present invention operates, the gas between the first anode portion and the cathode are broken down by high-voltage current to form a circuit, and an arc is generated. The arc moves to the next anode portion farther from the cathode under pull force of the primary gas admission supplied from near the cathode. At this time, the secondary gas admission is supplied tangentially to ensure the arc root does not fall to a next stage of arc channel, the arc will be lengthened step by step and so forth until to the last stage of the anode. The voltage of the plasma generator is increased by lengthening the arc. Since the multi-stage gas admission are supplied in the tangential direction, a good wind field is organized, and the total amount of wind is increased greatly, the distance between actual discharge positions of the anode and the cathode is increased, and the length of the arc is enlarged, the output voltage of the generator is increased, and the power of the plasma generator is improved at a defined input current.

DETAILED DESCRIPTION OF THE PREFERRED EMBODIMENT

A multi-stage gas-admission anode disclosed in the present invention organizes gas flows in order mainly by internal structure design, further continues the state of laminar flow of gas by energy supplementation in the next stage of gas, so that the anode arc root of the arc drops out of the gas distribution only at the last anode portion.

Figure 2:
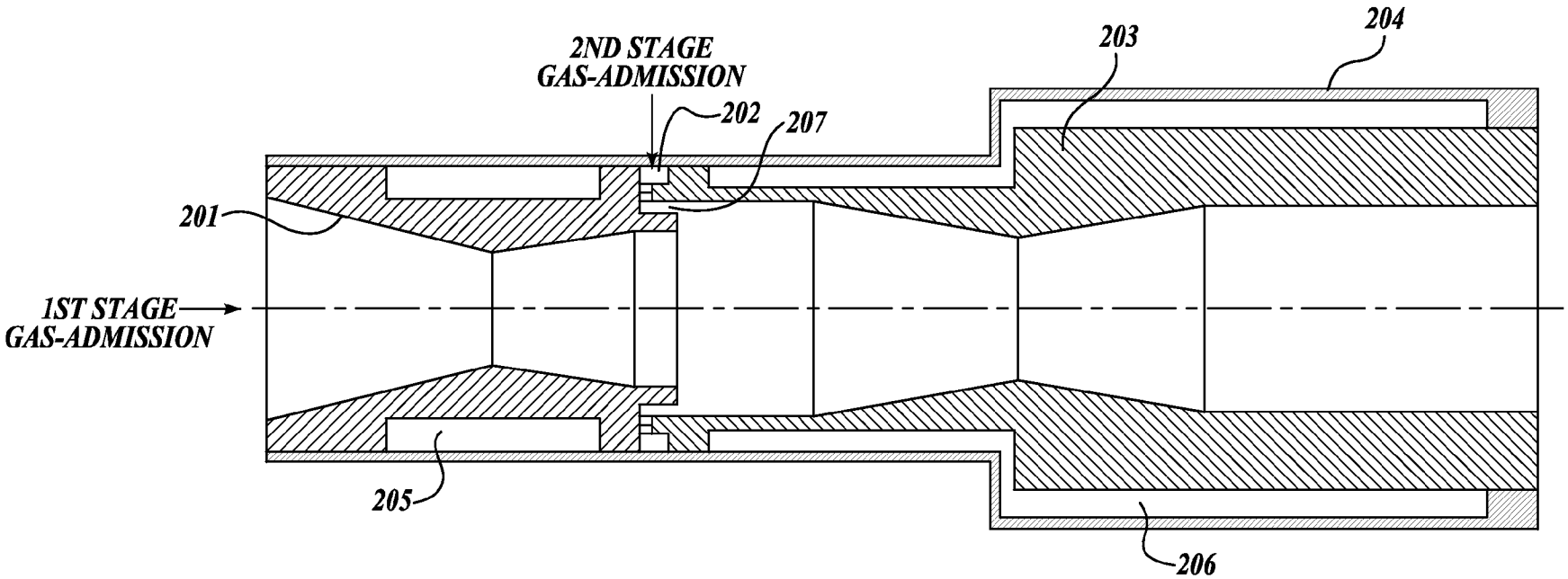
FIG. 2 is a schematic diagram of a first structure of an anode of a two-stage gas-admission plasma generator according to the present invention.
Figure 3:
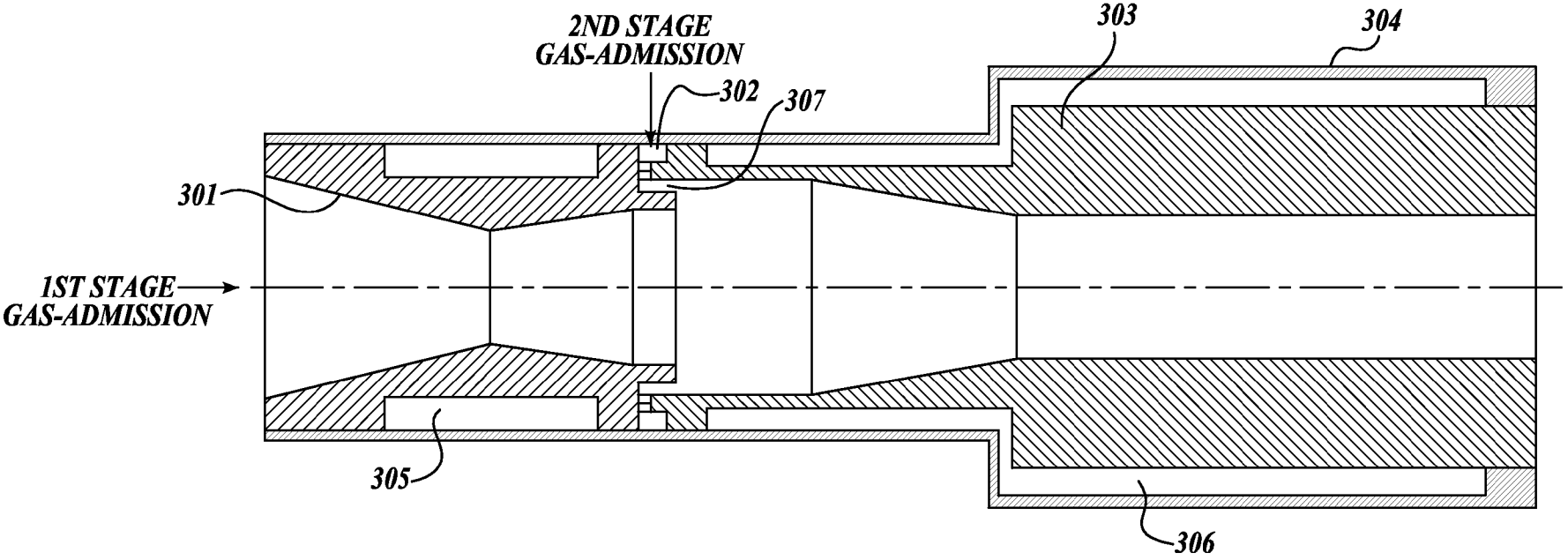
FIG. 3 is a schematic diagram of a second structure of an anode of a two-stage gas-admission plasma generator according to the present invention.
Figure 4:
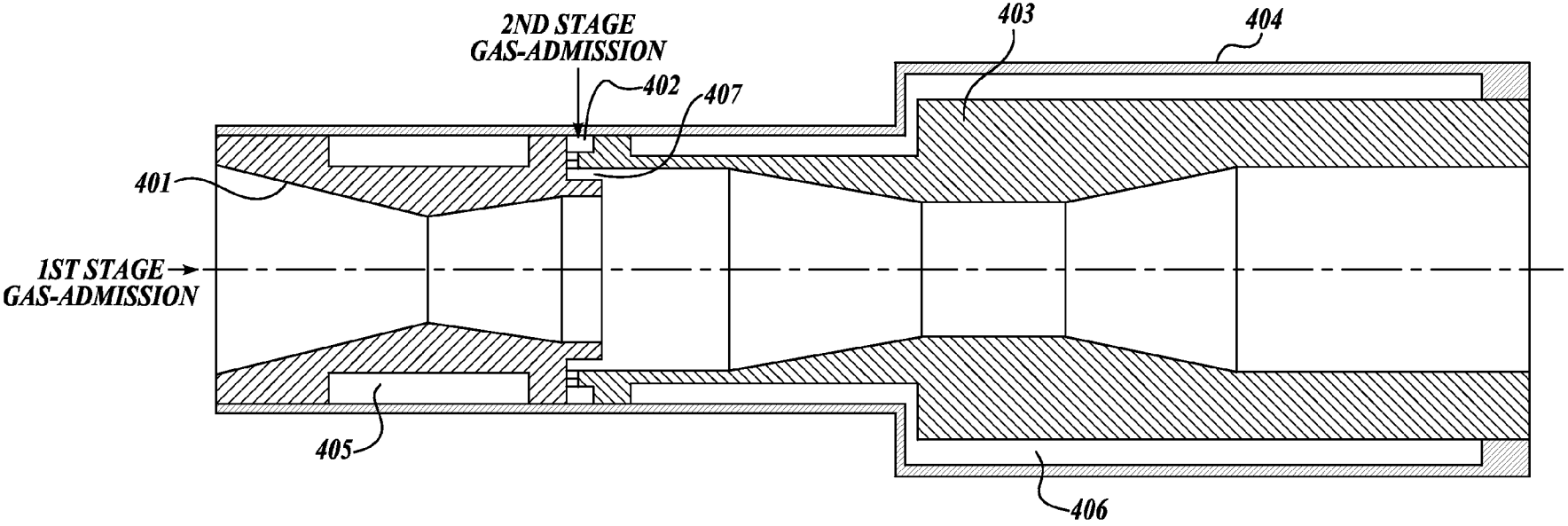
FIG. 4 is a schematic diagram of a third structure of an anode of a two-stage gas-admission plasma generator according to the present invention.
Figure 5:
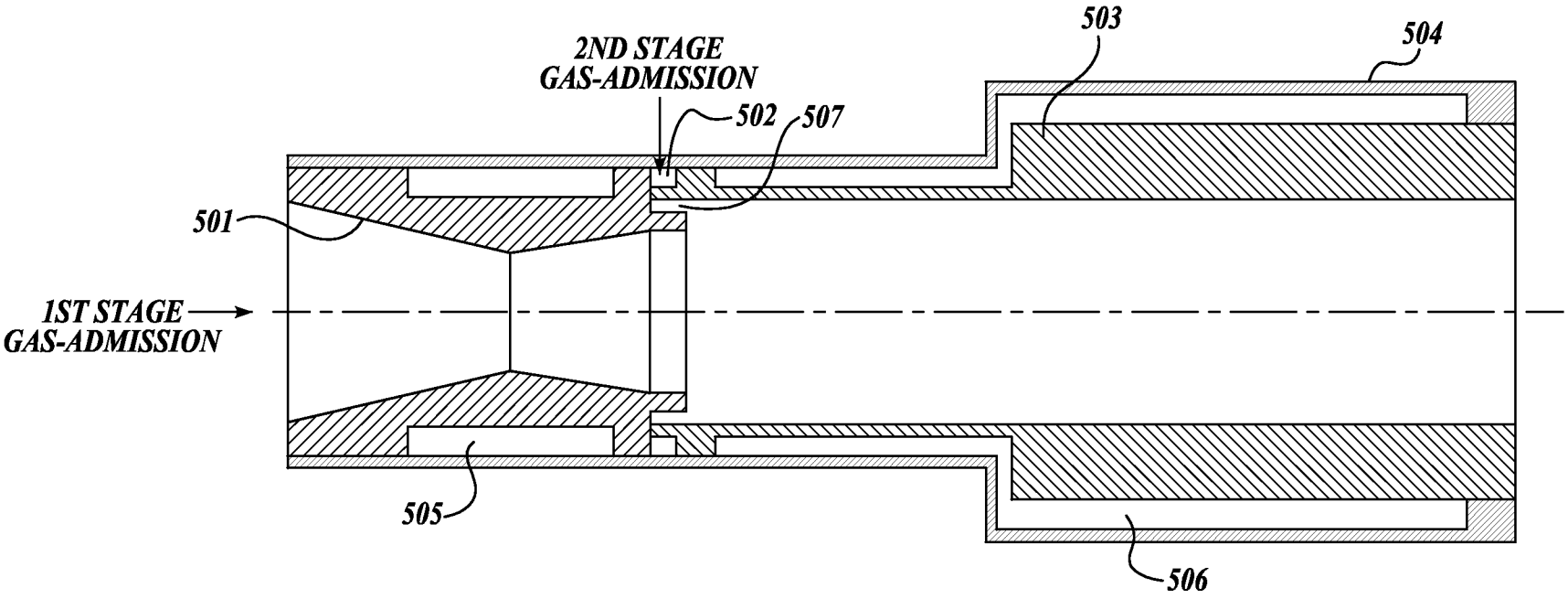
FIG. 5 is a schematic diagram of a fourth structure of an anode of a two-stage gas-admission plasma generator according to the present invention.

Referring to FIGS. 2-5, the structures of two-stage gas-admission anodes that the present invention relates to are illustrated schematically respectively. In FIG. 2, a last anode portion farthest from the cathode only contains a gradually narrowing-expanding throat component; In FIG. 3, a last anode portion farthest from the cathode only contains a gradually narrowing throat component; In FIG. 4, a last anode portion farthest from the cathode contains a component consisted of a gradually narrowing throat and a gradually expanding throat, which component includes a straight section between two throats; in FIG. 5, a last anode portion farthest from the cathode only contains a straight section component. Based on above different structured anode, plasma jet of different temperature filed can be obtained, so as to be applied to different fields. As known from FIGS. 2-5, an anode portion nearest to the cathode contains a gradually narrowing-expanding throat component; except the anode portion farthest from cathode, the remaining anode portions include respectively a gradually narrowing-expanding throat component.

The plasma generator including the anode shown in FIGS. 2-5, comprises two parts, i.e., an anode and a cathode. Wherein the anode includes a first anode portion 201 (301, 401, 501) nearest to the cathode, gas guiding holes 202 (302, 402, 502) between the anode portions, a second anode portion 203 (303, 403, 503), an anode sealing sheath 204 (304, 404, 504) for sealing the anode, a water-cooling channel 205 (305, 405, 505) for the first anode portion, a water-cooling channel 206 (306, 406, 506) for the second anode portion, and a flow guiding groove 207 (307, 407, 507).

Wherein there are provided gas guiding holes 202 (302, 402, 502) between any two adjacent anode portions, the gas guiding holes are tangential holes or holes that cause the direction of gas flow velocity to posses tangential and axial vectors simultaneously, and the gas guiding holes are distributed over the anode or one gas ring uniformly.

End faces of the two adjacent anode portions adjoin and contact one another sufficiently, at the contact position, the diameter of the anode portion farther from the cathode is bigger than that of the other anode portion to form a flow guiding groove 207 (307, 407, 507) at the contact position, introducing the medium gas introduced by the gas guiding holes 202 (302, 402, 502) into a plasma generator in order. Wherein the flow guiding groove 207 (307, 407, 507) is formed by a throat and an arc channel of next stage, the function of which is that the medium gas can be introduced into the generator in order so that gas flow in the anode forms a swirling flow, and the inner wall of the anode is cooled sufficiently and the arc root drops finally into the last stage of the anode.

It follows that, the flow guiding groove 207 (307, 407, 507) forms a channel along with an intracavity of the anode, in which the gas flow exported by the gas guiding holes 202 (302, 402, 502) goes forward spirally along the wall of the intracavity of the anode and the arc root is conveyed forward into the anode portion farthest from the cathode.

Wherein, each anode portion contains a water-cooling circuit that cools each stage of the anode sufficiently to ensure the lifetime of each stage of the anode.

When the plasma generator operates, a primary gas admission enters from the first anode portion 201 (301, 401, 501), a secondary gas admission is supplied from the gas guiding holes 202(302, 402, 502) between the anode portions. Upon the guidance of the flow guiding groove 207 (307, 407, 507), since a good wind field is formed by inter-cooperation of each stage of gas admission, the anode arc root drops into the second anode portion 203 (303, 403, 503) which increases the length of the arc and increases the output voltage of the generator, and improves the power of the generator at a defined input current.

Figure 6:
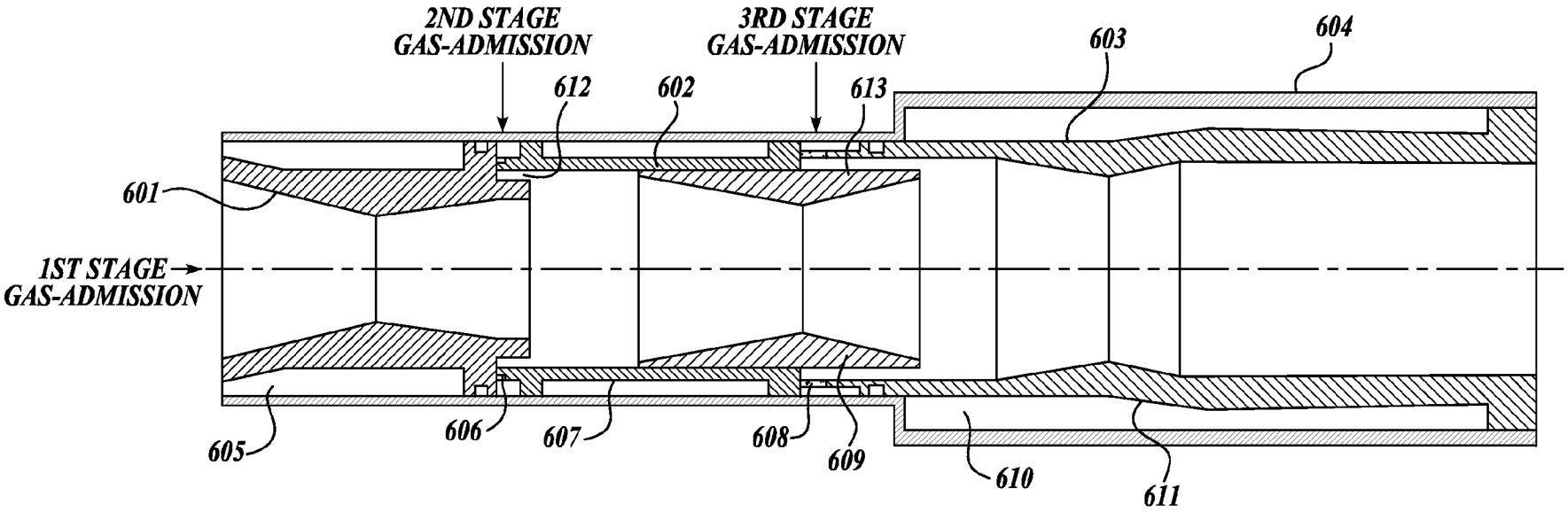
FIG. 6 is a schematic diagram of structure of an anode of a third-stage gas-admission plasma generator according to the present invention.

The FIGS. 2-5 is illustrated by an anode of two-stage gas admission, it can be conceived that, the structure of multi-stage gas admission is similar to that of two-stage gas admission. FIG. 6 shows a schematic structure of three-stage gas admission anode. The plasma generator with such anode includes: a first anode portion 601, a second anode portion 602, a third anode portion 603, an anode sealing sheath 604, a water-cooling channel 605 for the first anode portion, s second stage of gas guiding holes 606, a water-cooling channel 607 for the second anode portion, a third stage of gas guiding holes 608, a second stage of gradually narrowing-expanding larynx aperture 609, a water-cooling channel 610 for the third anode portion, a third stage of gradually narrowing-expanding larynx aperture 611, a second stage of flow guiding groove 612 and a third stage of flow guiding groove 613. The operating principle and the technical effects are the same as those as shown in FIGS. 2-5, and the description thereof is omitted.

In order to understand the present invention more clearly, two embodiments of the plasma generator are introduced as follows, one is a plasma generator of hot cathode type, and the other is a plasma generator of cold cathode type.

Figure 7:
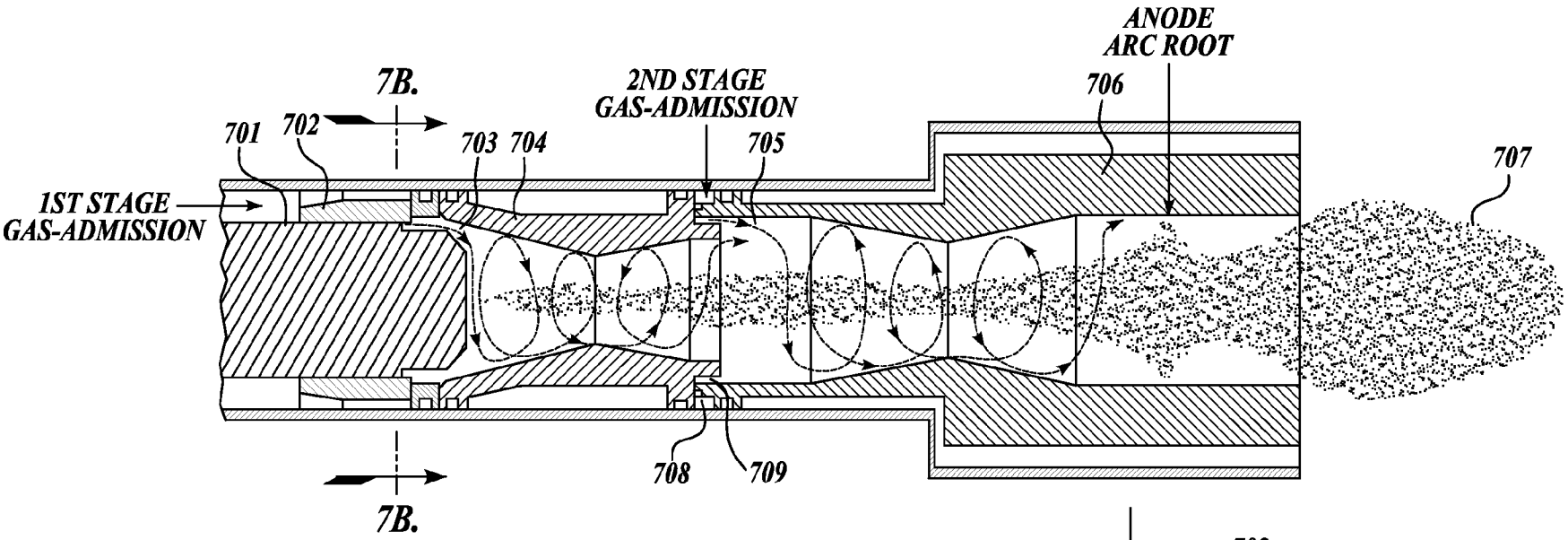
FIG. 7 is a schematic diagram of structure of a two-stage gas-admission arc plasma generator of hot cathode type.

Embodiment 1:

FIG. 7 is a structure diagram of an arc plasma generator of hot cathode type formed by an anode of two-stage gas admission.

Wherein 701 is a tip emitting cathode, 702 is a gas ring, 703 is a spiral gas flow formed by the first-stage gas admission after it passes by the gas ring 702, 704 is a first anode portion, 705 is a spiral gas flow by the second-stage gas admission after it passes from the gas guiding holes 708 by a flow guiding groove 709, 706 is a second anode portion, 707 is a movement track of the arc, 708 are gas guiding holes, and 709 is a flow guiding groove.

Figure 7B:
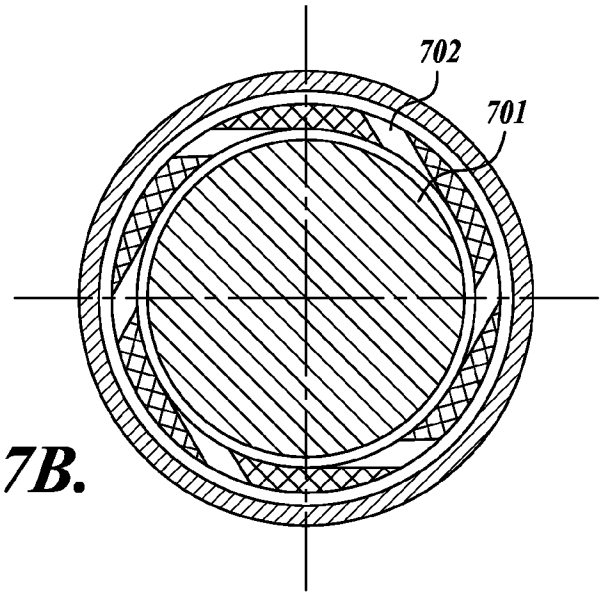
FIG. 7*b* is a section view of a gas ring 702 in FIG. 7.

FIG. 7*b* is a section view along plane A of the gas ring 702 in FIG. 7, wherein the gas ring 702 is made of an isolation material to avoid a short circuit between the cathode 701 and the first anode portion 704, the gas guiding holes in the gas ring 702 can be tangential holes, or the gas guiding holes that cause the direction of gas velocity to possess tangential and axial vectors simultaneously. The gas guiding holes between the cathode and the anode portion nearest to the cathode can be provided in the gas ring 702, or in the first anode portion 704.

Wherein the gas guiding holes 708 are provided between any two adjacent anode portions, the gas guiding holes are tangential holes, or the holes that make the direction of gas velocity possess tangential and axial vectors simultaneously, and the gas guiding holes are distributed over the anode or one gas ring uniformly.

End faces of the first anode portion 704 and the second anode portion 706 adjoin and contact one another sufficiently. At the contact position, the diameter of the second anode portion 706 is bigger than that of the first anode portion 704 to form, at the contact position, a flow guiding groove 709 for the flow guiding channel, so that the secondary gas admission introduced by the gas guiding holes 708 is introduced into the plasma generator in order.

It follows that, the flow guiding groove 709 forms a channel along with the intracavity of the anode, in which the gas flow exported by the gas guiding holes 708 goes forward spirally along the wall of the intracavity of the anode and the arc root is conveyed forward into the anode portion farthest from the cathode.

When the primary gas admission passes by the gas ring 702, the gas flow forms a spiral tangential movement along the wall in the first anode portion 704, under the action of the flow guiding holes in the gas ring 702; after the gas flow moves to the second anode portion 706, the spiral action of the gas flow are reduced under a sudden-expansion portion (the end face expanding portion between the first anode portion 704 and the second anode portion 706); when the secondary gas admission passes by the flow guiding groove 709 in the second anode portion 706 from the gas guiding holes 708, the secondary gas flow moves spirally along the tangential direction of the wall of the second anode portion 706 under the action of the flow guiding groove 709. After interaction between the primary gas admission and the secondary gas admission, the secondary gas flow goes forward in a spiral movement with enwrapping the primary gas flow.

Therefore, when arc passes between the cathode 701 and the anode (formed by the first anode portion 704 and the second anode portion 706), the arc is fixed to the central axis of the first anode portion 704 under the primary spiral movement of the gas flow; when the arc moves to the position of the second anode portion 706, if without the action of the secondary gas admission, the anode arc root will fall near an end surface of the first anode portion 704 as the gas flow is changed from the state of laminar flow to the state of turbulent flow. The gas flow is accelerated along the wall layer of the second anode portion 706 under the action of the secondary gas admission. So the arc is under the action of the moving gas flow, length of the arc is increased effectively, voltage of the arc is increased, and the power of the arc plasma generator is improved.

FIG. 7*b* is a section view of the gas ring 702 mounted in the generator, the gas ring 702 is a tangential gas ring. After the gas flow passes the tangential gas ring, a tangential spiral gas flow which goes spirally is formed, the central negative pressure formed by the tangential spiral gas flow not only fixes the arc to the central axis of the anode, but also forms a cool air protective film inside the anode, which protects the anode from being heated by the arc radiation and the damage to the arc root.

Figure 8:
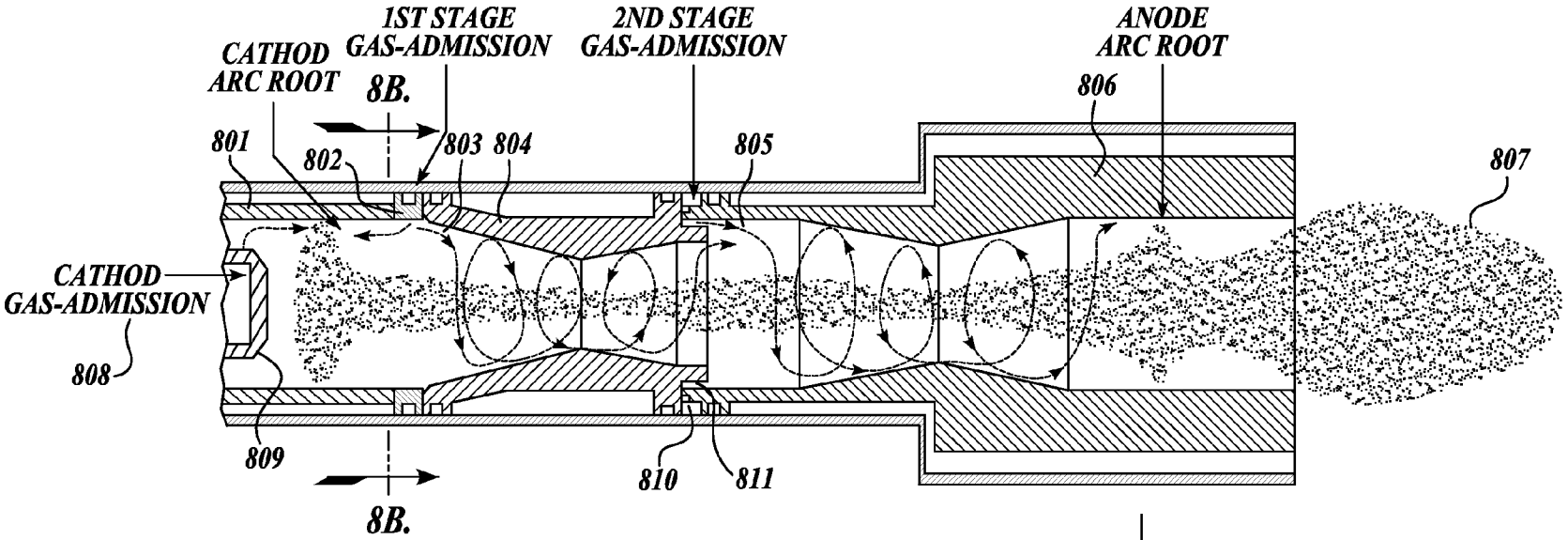
FIG. 8 is a schematic diagram of structure of a two-stage gas-admission arc plasma generator of cold cathode type.

Embodiment 2:

FIG. 8 is a structure diagram of an arc plasma generator of cold cathode type formed by an anode of two-stage gas admission.

Wherein 801 is a tubular cathode, 802 is a gas ring, 803 a spiral gas flow formed by the first-stage gas admission after it passes by the gas ring 802, 804 is a first anode portion, 805 is a spiral gas flow formed by the second-stage gas in take after it passes by a flow guiding groove 811 from the gas guiding holes 810, 806 is a second anode portion, 807 is a movement track of the arc, 808 is a cathode gas admission, 809 is a gas ring for the cathode gas admission, 810 are gas guiding holes, and 811 is a flow guiding groove.

Figure 8B:
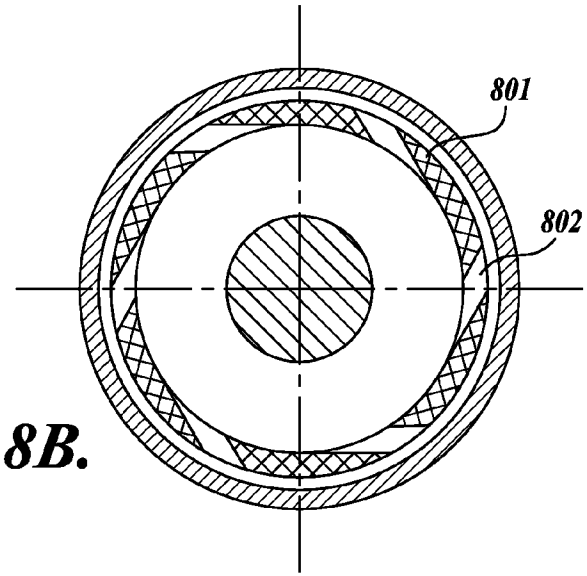
FIG. 8*b* is a section view of a gas ring 802 in FIG. 8.

FIG. 8*b* is a section view of the gas ring 802 shown in FIG. 8, the gas ring 802 is a tangential gas ring. Wherein the gas ring 802 is made of an isolation material to avoid a short circuit between the cathode 801 and the first anode portion 804, the gas guiding holes in the gas ring 802 are tangential holes. The gas guiding holes between the cathode and the anode portion nearest to the cathode can be provided in the gas ring 802, or in the first anode portion 804.

End faces of the first anode portion 804 and the second anode portion 806 adjoin and contact one another sufficiently. At the contact position, the diameter of the second anode portion 806 is bigger than that of the first anode portion 804 to form, so that a flow guiding groove 811 for the flow guiding channel is formed at the contact position, in which the secondary gas admission introduced by the gas guiding holes 810 is introduced into the plasma generator in order.

It follows that, the flow guiding groove 811 forms a channel along with the intracavity of the anode, in which the gas flow exported by the gas guiding holes 810 goes forward spirally along the wall of the intracavity of the anode and the arc root is conveyed forward into the anode portion farthest from the cathode.

When the primary gas admission passes by the tangential gas ring 802, the gas flow forms a spiral tangential movement in the first anode portion 804 along the wall thereof under the action of the gas guiding holes in the gas ring 802; after the gas flow moves to the second anode portion 806, the spiral action of the gas flow is reduced by a sudden-expansion portion (the end face expanding portion between the first anode portion 804 and the second anode portion 806); when the secondary gas admission passes by the flow guiding groove 811 in the second anode portion 806, the secondary gas flow forms a spiral movement along the tangential direction of the wall inside the second anode portion 806 under the action of the flow guiding groove 811. After interaction between the primary gas admission and the secondary gas admission, the secondary gas flow goes forward in a spiral movement with enwrapping the primary gas flow.

The cathode gas admission is introduced from a cathode gas admission ring 809. After passing the cathode gas admission ring 809, the gas flow becomes a gas flow which goes forward spirally, and encounters the primary gas admission in the channel of the cathode 801, the encountering point is the position where the arc cathode arc root moves. When the cathode gas flow and the primary air pressure vary regularly, the position of the cathode arc root varies correspondingly. The cathode arc root will move back and forth on the inner wall of the tubular cathode 801, the lifetime of the tubular cathode 801 is prolonged.

Therefore, when arc passes between the cathode 801 and the anode (formed by the first anode portion 804 and the second anode portion 806), the position and movement of the cathode arc root is determined by the conditions of the cathode gas admission and the primary gas admission; in the anode, the arc is fixed to the central axis of the first anode portion 804 under the action of the primary spiral movement of the gas flow; when the arc moves to the position of the second anode portion 806, if without the secondary gas admission, the anode arc root will fall near the end face of the first anode portion 804 as the gas flow will be changed from the state of laminar flow to the state of turbulent flow. The gas is accelerated along the wall layer of the second anode portion 806 under the action of the secondary gas admission. Under the action of the moving gas flow, arc spots are formed on the second anode portion 806, that is, due to that the arc is under the action of the moving gas flow, length of the arc is increased effectively, voltage of the arc is increased, and the power of the arc plasma generator is improved.

Figure 1:
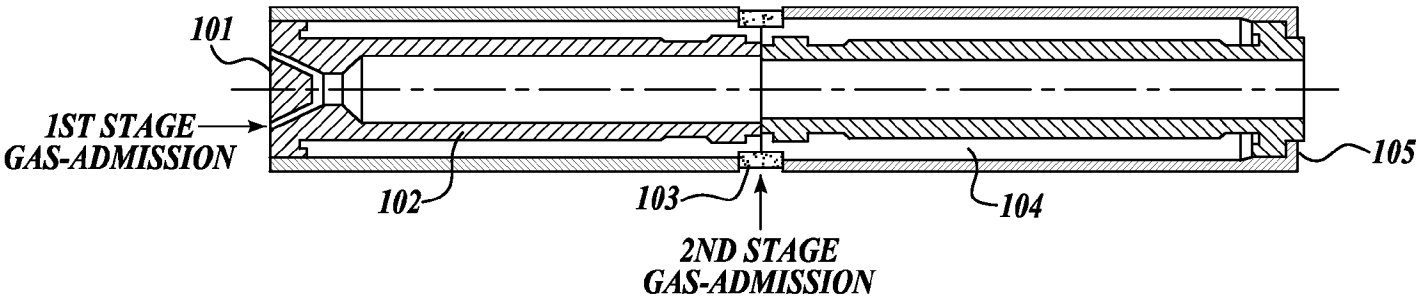
FIG. 1 is a schematic diagram of structure of a dual-anode plasma generator in the prior art.

As known from the above contents, the anode portions in the present application are electrically connected therebetween. As shown, e.g. in FIG. 2, the first anode portion 201 and the second anode portion 203 are two portions of the anode, which are made of an electrically conductive material and are directly closely abutted against one another; there is no transition at the connecting portion via isolation material, both of which are conductive. However, in the prior art, referring to FIG. 1, both 102 and 105 are an anode portion, which are made of an electrically conductive material, but there is an insulation material 103 between 102 and 105, and thus the connection between 102 and 105 is an insulating connection. The insulating connection between the anode portions will cause problems of many fault points, etc., and will affect stability of the arc. In the technical solution of the present invention, the anode portions are connected electrically therebetween, and thus the above problems are avoided, and the stability of the arc is improved.

Additionally, it should be noted that, the anode of an arc plasma generator and the arc plasma generator provided by the present invention can be applied in the field of high power plasma generator.

Though the various preferred exemplary embodiments of the invention have been illustrated and described as above, those skilled in the art would appreciate that, modifications and improvements to the embodiments may be made without departing from the scope and spirit of the invention, and the modifications and improvements also fall within the protection scope of the invention.

The invention claimed is:

1. An anode of an arc plasma generator, the plasma generator is a multi-stage gas admission type arc plasma generator, the plasma generator includes a cathode and an anode, the anode comprises at least two portions, wherein any two adjacent anode portions are connected electrically with one another, wherein there are provided gas guiding holes between any two adjacent anode portions, the gas guiding holes being tangential holes or holes that cause the direction of gas flow speed to possess tangential and axial vectors simultaneously, wherein end faces of the two adjacent anode portions adjoin and contact one another sufficiently, at the contact position, the diameter of the anode portion farther from the cathode is bigger than that of the other anode portion to form a flow guiding groove, introducing medium gas introduced by the gas guiding holes into the plasma generator in order, and wherein the flow guiding groove forms a channel along with an intracavity of the anode, in which the gas flow exported by the gas guiding holes goes forward spirally along the wall of the intracavity of the anode and an arc root is conveyed forward into the anode portion farthest from the cathode.

2. The anode of an arc plasma generator as claimed in claim 1, characterized in that, the anode portion farthest from the cathode includes any one of the following components:

a gradually narrowing-expanding throat component, a gradually narrowing throat component, a component consisted of a gradually narrowing throat and a gradually expanding throat, and a straight section component.

3. The anode of an arc plasma generator as claimed in claim 2, characterized in that, the anode portion nearest to the cathode portion includes a gradually narrowing-expanding throat component.

4. The anode of an arc plasma generator as claimed in claim 2, characterized in that, except the anode portion farthest from the cathode, all of the remainder of the anode portions include respectively a gradually narrowing-expanding throat component.

5. The anode of an arc plasma generator as claimed in claim 1, characterized in that, the gas guiding holes are distributed over the anode or a gas ring uniformly.

6. An arc plasma generator, characterized in that, it comprises an anode as claimed in claim 1.

7. The arc plasma generator as claimed in claim 6, characterized in that, there is provided a gas insulating ring between the cathode and the anode portion nearest to the cathode.

8. The arc plasma generator as claimed in claim 6, characterized in that, the plasma generator is an arc plasma generator of hot cathode type, wherein there are provided gas guiding holes between the cathode and the anode portion nearest to the cathode, the gas guiding holes are tangential holes or holes that cause the direction of gas flow speed to possess tangential and axial vectors simultaneously.

9. The arc plasma generator as claimed in claim 6, characterized in that, the plasma generator is an arc plasma generator of cold cathode type, wherein there are provided gas guiding holes between the cathode and the anode portion nearest to the cathode, the gas guiding holes are tangential holes.

* * * * *